US005397531A

United States Patent [19]

Peiris et al.

[11] Patent Number: 5,397,531

[45] Date of Patent: Mar. 14, 1995

[54] INJECTION-MOLDABLE METAL FEEDSTOCK AND METHOD OF FORMING METAL INJECTION-MOLDED ARTICLE

[75] Inventors: D. Dunstan H. Peiris; Jian G. Zhang, both of Singapore, Singapore

[73] Assignee: Advanced Materials Technologies Pte Limited, Singapore

[21] Appl. No.: 71,447

[22] Filed: Jun. 2, 1993

[30] Foreign Application Priority Data

Jun. 2, 1992 [GB] United Kingdom ..... 9211586
Nov. 24, 1992 [GB] United Kingdom ..... 9224632

[51] Int. Cl.[6] ..... B22F 3/00

[52] U.S. Cl. ..... 419/36; 419/44; 419/53; 419/54

[58] Field of Search ..... 419/36, 38, 41, 53, 419/54, 56, 55; 75/246, 255; 524/385, 183, 439; 264/102, 40.6

[56] References Cited

U.S. PATENT DOCUMENTS

| | | | |
|---|---|---|---|
| 4,197,118 | 4/1980 | Wiech, Jr. | 75/228 |
| 4,404,166 | 9/1983 | Wiech, Jr. | 419/36 |
| 4,544,694 | 10/1985 | Bower | 524/385 |
| 4,661,315 | 4/1987 | Wiech, Jr. | 419/10 |
| 4,765,950 | 8/1988 | Johnson | 419/2 |
| 4,795,598 | 1/1989 | Billiet | 264/40.6 |
| 5,006,164 | 4/1991 | Kiyota | 75/255 |
| 5,108,492 | 4/1992 | Kiyota et al. | 75/246 |
| 5,122,326 | 6/1992 | Jackson et al. | 264/102 |
| 5,135,977 | 8/1992 | Achikita et al. | 524/183 |
| 5,198,489 | 3/1993 | Sterzel et al. | 524/439 |
| 5,213,730 | 5/1993 | Hida | 264/63 |
| 5,240,513 | 8/1993 | McCallum et al. | 148/104 |
| 5,286,802 | 2/1994 | Uesugi et al. | 525/309 |

FOREIGN PATENT DOCUMENTS

| | | |
|---|---|---|
| 0324122 | 7/1989 | European Pat. Off. . |
| 0400778 | 5/1990 | European Pat. Off. . |
| 0409646 | 1/1991 | European Pat. Off. . |
| 59-121150 | 12/1982 | Japan . |
| 3290374 | 4/1990 | Japan . |
| 365552 | 3/1991 | Japan . |

*Primary Examiner*—Donald P. Walsh
*Assistant Examiner*—John N. Greaves
*Attorney, Agent, or Firm*—Ladas & Parry

[57] ABSTRACT

Metal injection-molded green bodies (2) are formed from a granulated feedstock comprising metal powder and a binder comprising:

a) 15–25 volume % paraffin wax b) 20–30 volume % microcrystalline wax c) 45–60 volume % polyethylene.

The paraffin wax has two melting regions around 45° C. and 63° C. and the microcrystalline wax exhibits four melting regions in the range 62° C. and 144° C. By raising the temperature of the oven in a controlled manner, first the paraffin wax and then the microcrystalline wax melts and is vapourised and entrained in a flow of carrier gas which flows over supporting trays (5), as indicated by the horizontal arrows (a). The requirement for wicking powder is eliminated by the staged removal of the wax and the polyethylene can subsequently be removed at a higher temperature by thermal depolymerisation in the same apparatus.

15 Claims, 1 Drawing Sheet

INJECTION-MOLDABLE METAL FEEDSTOCK AND METHOD OF FORMING METAL INJECTION-MOLDED ARTICLE

BACKGROUND OF THE INVENTION

1. Field of the Invention

The present invention relates to metal injection-molding (MIM) and in particular relates to an injection-moldable metal powder-binder feedstock and to a method of forming a metal injection-molded article. Metal injection-molding involves mixing one or more metal or alloy powders with a fugitive binder to form a homogeneous injection-moldable feedstock, which is then injection-molded to form a shaped body which is commonly referred to as a "green body". The binder is then removed from the green body and the body is then sintered to fuse the metal powder to a solid which retains the original injection-molded shape.

2. Description of the Related Art

Various binders are known in the prior art and typically consist of plain paraffin wax or carnauba wax and one or more polymers. The wax components act as a lubricant during injection-molding and have conventionally been removed by placing the injection-molded green body on a bed of finely divided alumina-ceramic powder and melting the wax binder. The molten wax is sucked out of the green body into the alumina powder bed by capillary action. However, such a process tends to roughen the surface of the product and the cost of the required grade of alumina powder represents a significant expense.

Other techniques used in the prior art include the use of various solvents to remove the binder but such techniques lead to additional complications and disadvantages.

SUMMARY OF THE INVENTION

In one aspect, the present invention provides an injection-moldable metal powder-binder feedstock comprising metal powder and binder, the binder comprising a lubricant and an organic polymer, the lubricant and organic polymer being removable by melting and evaporation respectively from an injection-molded article formed from the feedstock, the lubricant being composed of two or more waxes and having two or more melting temperatures whereby the lubricant can be removed progressively from such an injection-molded article by raising the temperature in a controlled manner from below the lowest melting temperature to above the highest evaporation temperature of the lubricant.

Preferably, at least one of said waxes has two or more melting temperatures. Typically, the waxes have molecular weights in the range 10,000–50,000.

Advantageously said lubricant comprises paraffin wax and microcrystalline wax. Conveniently said polymer is polyethylene.

Preferably said polyethylene has a melt flow index of not less than 30 g/10 minutes (ASTM D 1238-88).

Preferably said binder comprises:

a) 15–25 volume % paraffin wax b) 20–30 volume % microcrystalline wax c) 45–60 volume % polyethylene.

Advantageously said metal powder has a size distribution within the range 0.4 to 15 μm, and conveniently said metal powder has a size distribution within the range 0.4 to 5 μm.

Preferably said metal powder has two peaks in its size distribution spectrum.

In another aspect, the invention provides a method of forming a metal injection-molded article comprising:

i) injection-molding a feedstock comprising metal powder and binder to form an injection-molded body, said binder comprising a wax lubricant having a range of melting temperatures and an organic polymer;

ii) progressively removing said wax lubricant from said injection-molded body by raising the temperature of said body through said range of melting temperatures;

iii) thermally removing said organic polymer from said injection-molded body, and iv) subsequently sintering said injection-molded body to fuse said metal powder and form said metal article.

Preferably, in the above process, the injection-molded body is supported on a support member which does not exert a wicking action on the liquified wax lubricant. Preferably, the liquified wax lubricant is vaporized and carried away from the injection-molded body as vapour entrained in a gas stream.

Conveniently a plurality of such injection-molded bodies are supported on one or more trays in an oven and a gas stream flows across the upper surface of each tray and sweeps liquified wax away from said injection-molded bodies in a predetermined direction towards an edge of each tray. Preferably, in such an arrangement, said trays are arranged in a stack and said gas stream flows in alternate directions over successive trays in the stack.

Advantageously said wax lubricant is composed of two or more waxes. Preferably said wax lubricant is removed in two or more stages, each stage comprising raising the temperature of said injection-molded body at a predetermined rate and then holding said temperature for a predetermined period.

Preferably, the wax lubricant comprises 15–25 parts by volume of paraffin wax and 20–30 parts by volume of microcrystalline wax and the temperature of the injection-molded body is raised at a rate not greater than 300° C./hour to a holding temperature of 80° C. to 120° C. and is then raised at a rate of not greater than 100° C./hour to a holding temperature of 200° C. to 280° C.

Preferably said organic polymer is polyethylene and is partially removed by endothermic depolymerisation during a controlled heating stage, the remaining polyethylene being removed by exothermic depolymerisation at a subsequent heating stage.

The invention enables the wax lubricant to be removed in a controlled manner from the injection-molded body and, in particular, avoids the formation of a large body of liquid in the injection-molded body which could erode or break up the body as it flows away.

Furthermore, the invention enables very high volume loadings of metallic powder, typically 1% to 6% below the critical volume loading, to be used. The volume loading is defined as the ratio of the volume of metallic powder to the volume of the binder, expressed as a percentage. The critical volume loading can be determined by a pycnometer evaluation, as known to those skilled in the art.

By utilising a volume loading of metal powder which approaches the critical volume loading, shrinkage of the injection-molded body during sintering is minimized and, furthermore, the binder can be removed quickly and easily even from injection-molded green bodies having hanging or cantilevered sections, without requiring any special supports for these sections.

The invention is applicable to a wide range of metal powders such as, for example, tungsten, tungsten alloys, stainless steels, carbon steel and powders derived from iron carbonyl and nickel carbonyl.

Preferably, the particle size of the metal powder is in the range 0.4 to 15 micrometers, more preferably 0.4 to 10 micrometers or, ideally, 0.4 to 5 micrometers. Preferably, there is a double peak in the size spectrum of the metal powder.

The invention enables sintered products to be obtained whose density is 95–99% of the theoretical density.

In a preferred embodiment, a feedstock containing unfilled (i.e. pure) polyethylene is utilised and the polyethylene is removed by thermal depolymerisation, initially at a temperature appropriate to endothermic depolymerisation. This enables the polyethylene to be removed via a controlled equilibrium process. The depolymerisation is continued at a temperature above the crystalline melting point at which temperature it becomes exothermic. The resulting internal heating of the injection-molded body keeps its temperature more uniform (particularly when a large number of injection-molded bodies are being treated in an oven) and reduces the risk of premature sintering due to the externally applied heat.

In the above embodiment, the polyethylene is not depolymerised until after all the wax has been removed during a preceding low-temperature stage of the process.

BRIEF DESCRIPTION OF THE DRAWINGS

A preferred embodiment of the invention will now be described by way of example only with reference to FIGS. 1 and 2 of the accompanying drawings, wherein.

DESCRIPTION OF THE PREFERRED EMBODIMENTS

Figure 1:
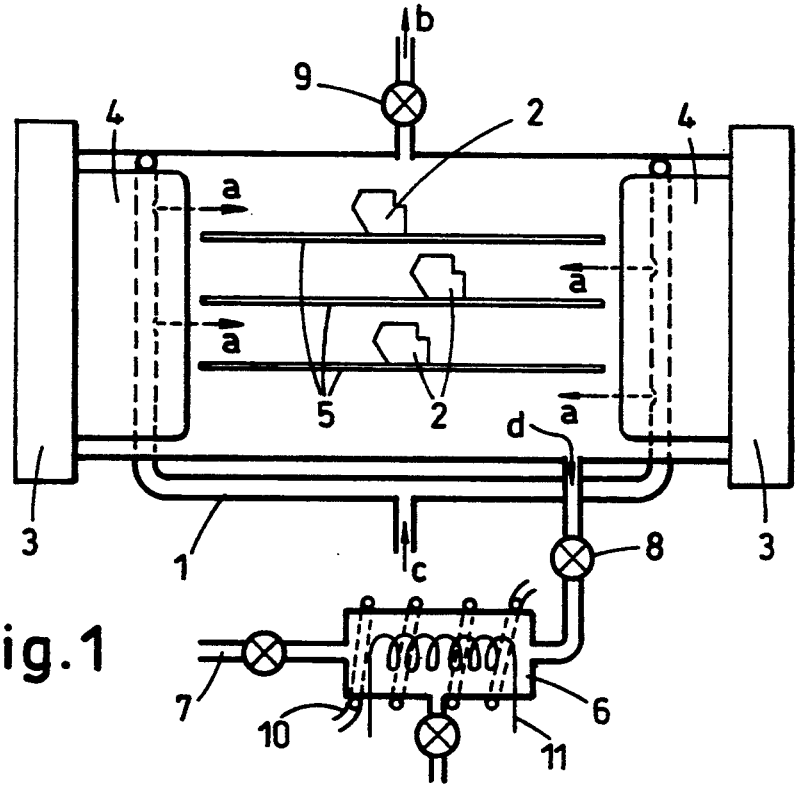
FIG. 1 is a diagrammatic sectional elevation of an apparatus for removing a binder from a metal injection-molded body in accordance with the invention.

The preferred binder composition for use in the invention comprises:

i) 15–25% by volume of paraffin wax, containing 2% oil;

ii) 20–30% by volume of microcrystalline wax, the molecular weights of these waxes being in the range 10,000–50,000;

iii) 45–60% by volume of polyethylene having a melt-flow index of not less than 30 g/10 minutes, and having a molecular weight in the range 150,000–250,000, and iv) 2–5% by volume of stearic acid.

The stearic acid acts as a surfactant and etches the metal powder to ensure a better coating of the binder, and also acts as a mould-release agent.

To prepare a feedstock containing the above binder, the, or each, metal powder is dried and is blended well with the stearic acid component in a blender. The blended powder mix is then heated to a temperature of 20° C. below the melting temperature of the polyethylene, but not exceeding 150° C. The blended metal powder/stearic acid component is then fed into a plasticised blend of the paraffin wax, microcrystalline wax and polyethylene and mixed under low and high shear conditions in a double planetary mixer.

The feedstock density is checked and should have a density within $\pm 0.1$ g/cm$^3$ of a predetermined level.

The feedstock is then granulated to a size spectrum ranging from fine to a maximum of 3 mm, preferably 1 mm to 3 mm.

The resulting granulated feedstock can then be injection-molded using standard equipment, preferably at a temperature of 170° C. to 220° C., advantageously 150° C. to 200° C. The resulting molded "green bodies" should have a weight variation of not more than $\pm 0.2\%$ (for parts weighing 1 g to 10 g) or not more than $\pm 0.5\%$ (for parts weighing 10 g to 30 g).

Referring to FIG. 1, the injection-molded green bodies 2 are placed on trays 5 within the temperature-controlled oven, which may be electrically heated for example. The oven is provided at either end with water or air cooled doors 3 which are insulated from the interior of the oven by heat cousions 4. A gas inlet pipe 1 enters the oven and two branches thereof encircle the heat cousions 4 and a carrier gas, typically nitrogen or a blend of 15% hydrogen and 85% nitrogen is introduced at a pressure of about 0.3 to 0.43 atmospheres (4 to 6 psi) at a flow rate of 0.5 to 1 standard cubic meters per hour for each cubic meter of effective oven volume, as illustrated by arrow headed line c. The branches of the inlet pipe 1 have apertures spaced around the heat cousions 4 which are aligned with the spaces between the trays 5 and which direct the carrier gas in alternate directions over successive trays in the stack, as illustrated by arrow headed line a. The carrier gas initially exits valve outlet 8, as illustrated by arrow headed line d, carrying entrained wax vapour which is cooled in a trap 6 having an external cooling system 10 and an internal cooling system 11. When the wax components of the binder have been removed, the outlet 7 of trap 6 is closed and the temperature is raised to initiate depolymerisation of the polyethylene. During this high temperature stage, the valve of outlet 9 is opened and the carrier gas containing the depolymerisation products exits from this outlet as shown by arrow headed line b.

Figure 2:
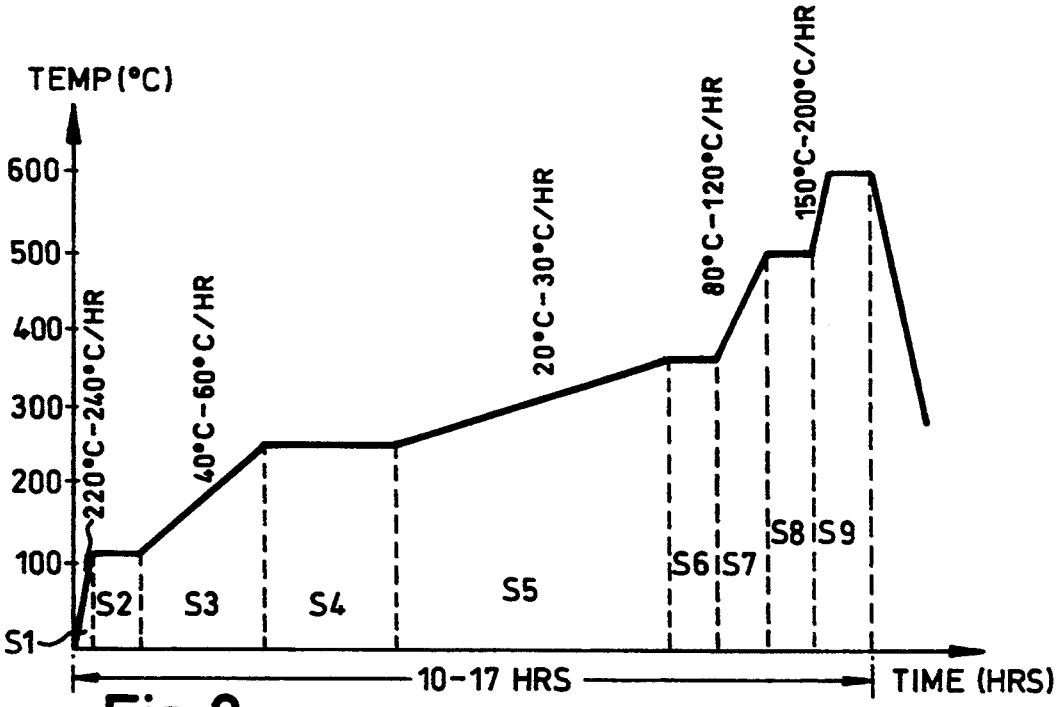
FIG. 2 shows a temperature-time profile applicable to the removal of the binder in the apparatus of FIG. 1.

The removal of the binder using the apparatus of FIG. 1 will now be described with reference to the heating profile, as shown in FIG. 2, which is applicable to a binder incorporating paraffin wax having melting regions around 45° C. and 63° C. and microcrystalline wax which registers four melting regions in the range 62° C. to 144° C.

As the temperature in the oven is progressively increased, the paraffin wax in the binder gradually melts and flows out, creating fine paths for the subsequent melting of the microcrystalline wax at higher temperatures. The gradual rise in temperature within the injection-molded bodies 2 and the staged melting of the wax components avoids the formation of a destructive liquid mass in the vicinity of the injection-molded bodies.

Initially, as shown in stage S1 in FIG. 2, the contents of the oven are heated rapidly at a rate of 220° C.–240° C. per hour to a temperature of 110° C. (for parts of 0.5 mm–5 mm thickness) or 90° C. (for parts of 5 mm–15 mm thickness).

The temperature is then held (stage S2) for a calculated period, e.g. 1.1 minutes per liter of oven volume (0.5 hour/cubic foot).

During periods S1 and S2, most of the wax is removed from the injection-molded bodies 2.

The temperature is then raised to 230° C.–250° C. at the rate of 40° C.–60° C./hour (stage S3) and held for 1.1 minutes per liter of effective oven capacity (half an hour for each cubic foot of oven capacity), to enable the wax to vapourise and to be entrained in the carrier gas and purged out of the oven without congestion. This stage is shown as S4 in FIG. 2.

The temperature is then raised at 20° C.–30° C. per hour to 375° C. and held for half an hour (stages S5 and S6). Endothermic depolymerisation of the polyethylene begins at about 350° C. and continues until the end of stage S6. The temperature is then raised at a rate of 80° C.–120° C. per hour to 500° C. (stages S7 and S8) and is finally raised to 600° C. at a rate of 150° C.–200° C. per hour and held at 600° C. for 0.54 minutes per liter of oven volume (15 minutes/cubic foot), as shown at stage S9 in FIG. 2. Exothermic depolymerisation of the polyethylene occurs over the temperature range 375° C. to 450° C.

During these latter stages, when the polyethylene is depolymerised, the valve on outlet 9 and the valve on outlet 8 are shut (FIG. 1).

In general, the lower range of heating rates given above are applicable to parts 2 of dimension greater than 8 mm and the higher range of heating rates is applicable to parts of dimension below 8 mm.

For thick wall parts (greater than 15 mm), the low temperature polymer removal stage S4 can be assisted by closing the carrier gas inlet 8 and connecting the binder trap outlet 7 to a vacuum pump.

The final stage S9 in FIG. 2 is a pre-sintering stage and the pre-sintered bodies 2 can be sintered in a standard sintering furnace under vacuum of an inert gas and/or hydrogen. Typically, the sintering temperature will be in the range 1,000° C.–1,500° C. and the sintering time can be determined in a conventional manner.

The invention will now be illustrated further by a non-limiting example.

EXAMPLE

Carbonyl iron powder of average particle size 4–5 micrometers and having a carbon content of 0.03% and carbonyl nickel powder (123 grade) of average particle size 4–5 micrometers were utilised as the metallic raw materials. 10 kg of a mixture of the two metal powders containing 98% carbonyl iron powder and 2% carbonyl nickel powder were blended with 0.014 kg of stearic acid for one hour.

The well blended materials were heated to a temperature of 110° C. and added to a mixture containing a previously plasticised binder comprising 0.376 kg pure polyethylene, 0.154 kg paraffin wax, and 0.225 kg microcrystalline wax. The volume loading of the metal powder mixture in the binder was 62%. The resulting mixture was granulated to form a granulated feedstock for injection-molding and the granulated feedstock was injected into moulds. The weight of feedstock injected into each mould was controlled to within ±0.2%.

Molded green bodies 2 were placed on ceramic refractory plates 5, as illustrated in FIG. 1, and were subjected to binder removal in accordance with the temperature-time profile, illustrated in FIG. 2. Nitrogen was used as the carrier gas. The pre-sintered products were then sintered and a dimensional tolerance of ±2% and a density of 97% of the theoretical density were achieved.

It is to be understood that the invention has been described with reference to exemplary embodiments, and modifications may be made without departing from the spirit and scope of the invention as defined in the appended claims.

We claim:

1. A method of forming a metal injection-moulded article comprising:
   i) injection-moulding a feedstock comprising metal powder and binder to form an injection-moulded body, said binder comprising a wax lubricant having a range of melting temperatures and an organic polymer;
   ii) progressively removing said wax lubricant from said injection-moulded body by raising the temperature of said body through said range of melting temperatures and sweeping liquified wax away from said injection moulded body by means of a gas stream whilst said injection-moulded body is supported on a support member which does not exert a wicking action on the liquified wax lubricant;
   iii) thermally removing said organic polymer from said injection-moulded body, and
   iv) subsequently sintering said injection-moulded body to fuse said metal powder and form said metal article.

2. A method according to claim 1, wherein a plurality of such injection-molded bodies are supported on at least one tray in an oven and a gas stream flows across the upper surface of said at least one tray and sweeps liquified wax away from said injection-molded bodies in a predetermined direction towards an edge of said at least one tray.

3. A method according to claim 2 wherein a plurality of trays are arranged in a stack and said gas stream flows in alternate directions over successive trays in the stack.

4. A method according to claim 1 wherein said wax lubricant is composed of at least two waxes.

5. A method according to claim 1 wherein said wax lubricant is removed in at least two stages, each stage comprising raising the temperature of said injection-molded body at a predetermined rate and then holding said temperature for a predetermined period.

6. A method according to claim 1 wherein said feedstock comprises metal powder and binder, the binder comprising a lubricant and an organic polymer, the lubricant and organic polymer being removable by melting and evaporation respectively from an injection-molded article formed from the feedstock, the lubricant being composed of at least two waxes and having at least two melting temperatures whereby the lubricant can be removed progressively from such an injection-molded article by raising the temperature in a controlled manner from below the lowest melting temperature to above the highest evaporation temperature of the lubricant, and at least one of said waxes has at least two melting temperatures.

7. A method as claimed in claim 11 wherein said wax lubricant comprises 15 to 25 parts by volume of paraffin wax and 20 to 30 parts by volume microcrystalline wax and the temperature of said injection-molded body is raised at a rate not greater than 300° C./hour to a holding temperature of 80° C. to 120° C. and is then raised at a rate of not greater than 100° C./hour to a holding temperature of 200° C. to 280° C.

8. A method as claimed in claim 1 wherein said organic polymer is polyethylene and is partially removed by endothermic depolymerisation during a controlled heating stage, the remaining polyethylene being removed by exothermic depolymerisation at a subsequent heating stage.

9. A method as claimed in claim 1, wherein said wax lubricant comprises a multiple melting point microcrystalline wax and a paraffin wax.

10. A method as claimed in claim 1, wherein the volume loading of said metal powder is from 1% to 6% below a critical volume loading.

11. A method as claimed in claim 1, wherein said metal powder has a size distribution within the range 0.4 to 15 μm.

12. A method as claimed in claim 9, wherein said microcrystalline wax registers 4 melting regions in the range 62° C. to 144° C.

13. A method of forming a metal injection-moulded article comprising:

i) injection-moulding a feedstock comprising metal powder and binder to form an injection-moulded body, said binder comprising a wax lubricant having a range of melting temperatures and an organic polymer wherein said wax lubricant comprises 15 to 25 parts by volume of paraffin wax and 20 to 30 parts by volume microcrystalline wax and the temperature of said injection-moulded body is raised at a rate not greater than 300° C./hour to a holding temperature of 80° C. to 120° C. and is then raised at a rate of not greater than 100° C./hour to a holding temperature of 200° C. to 280° C.;

ii) progressively removing said wax lubricant from said injection-moulded body by raising the temperature of said body through said range of melting temperatures and sweeping liquified wax away from said injection moulded body by means of a gas stream whilst said injection-moulded body is supported on a support member which does not exert a wicking action on the liquified wax lubricant;

iii) thermally removing said organic polymer from said injection-moulded body, and iv) subsequently sintering said injection-moulded body to fuse said metal powder and form said metal article.

14. A method as claimed in claim 13 wherein said binder also comprises 45–60 volume % polyethylene.

15. A method of forming a metal injection-moulded article comprising:

i) injection-moulding a feedstock comprising metal powder and binder to form an injection-moulded body, said binder comprising a wax lubricant having a range of melting temperatures and an organic polymer, wherein said binder comprises a) 15–25 volume % paraffin wax b) 20–30 volume % microcrystalline wax c) 45–60 volume % polyethylene ii) progressively removing said wax lubricant from said injection-moulded body by raising the temperature of said body through said range of melting temperatures and sweeping liquified wax away from said injection moulded body by means of a gas stream whilst said injection-moulded body is supported on a support member which does not exert a wicking action on the liquified wax lubricant;

iii) thermally removing said organic polymer from said injection-moulded body, and iv) subsequently sintering said injection-moulded body to fuse said metal powder and form said metal article.

* * * * *